United States Patent [19]

Ritter et al.

[11] 4,360,724

[45] Nov. 23, 1982

[54] METHOD AND AN APPARATUS FOR STEPWISE MOVEMENT OF A REINFORCEMENT GRID

[75] Inventors: Klaus Ritter; Rudolf Scherr; Gerhard Ritter; Josef Ritter, all of Graz, Austria

[73] Assignee: EVG Entwicklungs-und Verwertungs Gesellschaft m.b.H, Graz, Austria

[21] Appl. No.: 121,267

[22] Filed: Feb. 13, 1980

[30] Foreign Application Priority Data

Feb. 20, 1979 [AT] Austria ..... 1312/79

[51] Int. Cl.[3] ..... B23K 9/1 2

[52] U.S. Cl. ..... 219/58; 219/56; 414/750; 414/751

[58] Field of Search ..... 219/56, 58; 414/750, 414/751

[56] References Cited

U.S. PATENT DOCUMENTS 3,676,632 7/1972 Ritter et al. ..... 219/56

FOREIGN PATENT DOCUMENTS 329950 6/1976 Austria .

1253215 5/1968 Fed. Rep. of Germany .

*Primary Examiner*—C. C. Shaw

*Attorney, Agent, or Firm*—Ernest F. Marmorek

[57] ABSTRACT

The invention relates to apparatus for and a method of moving a grid (G) longitudinally in stepwise fashion through a multi-spot welding machine by means of an element (5) arranged to engage a transverse rod (D) of the grid at a starting position, move the grid (G) forward through a number of steps at a first mean speed, and thereafter disengage from the rod (D) and return to the starting position at a mean speed greater than the first mean speed. The movement of the element (5) is controlled by a computer (31) so as to return to its starting position if the time required for its return from the position which it would occupy after the next step is greater than a preset maximum standstill time between steps.

13 Claims, 7 Drawing Figures

METHOD AND AN APPARATUS FOR STEPWISE MOVEMENT OF A REINFORCEMENT GRID

The invention relates to the manufacture of reinforcement grids having crossing longitudinal and transverse rods or bars in a multiple spot welding machine. The reinforcement grid is normally held by means of a number of transporting elements formed as hooks or grippers which hold a transverse rod and the reinforcement grid is transported forward by the amount of the required transverse rod spacing, after which the transport elements return into their initial positions. In each such transporting step a small distance error can occur and these individual errors are aggregated over the length of the reinforcement grid, so that there can arise unacceptably high cumulative errors.

In order to avoid such cumulative errors, it is known to leave the transporting elements in engagement with the first transverse rod welded-on during the whole grid-making operation and the individual steps are established by a number of stops along the travelling path of the transporting elements (see German Pat. No. DE-PS 1 253 215 filed on May 11, 1962 and issued on Nov. 2, 1967).

The disadvantage of the above arrangement is that the time which the transporting element requires for returning to the initial position after the completion of the reinforcement grid will significantly reduce the production rate. This disadvantage can be eliminated by the use of a number of groups of transporting elements which operate independently of each other and which engage in alternating pattern with a transverse rod of the grid and which can pass under or over each other (see AT-PS No. 329 950, filed on Feb. 20, 1979 and issued on June 10, 1976).

In both cases an appreciable amount of equipment is required for the establishment of the length of the individual transporting steps by the stops, so that, on the one hand, the changeover to another transverse rod spacing is troublesome and expensive and, on the other hand, error sources again arise due to wear. In addition, with the known arrangements, it is not possible to carry out special corrections for the required transporting steps, such as those which arise due to thermal expansion of the longitudinal rods as a result of the welding operations.

According to the invention a method of moving a grid longitudinally in stepwise fashion through a multispot welding machine by means of an element arranged to engage a transverse rod of the grid at a starting position, move the grid forward through a number of steps at a first mean speed, and thereafter disengage from the rod and return to the starting position at a mean speed greater than the first mean speed, comprises controlling the movement of the element so as to cause it to return to the starting position if the time required for its return from the position which it would occupy after the next step is greater than a preset maximum rest time or pause between steps.

Preferably, the movement of the element is controlled by a computer which calculates the return time from the mean speed of return of the element and the forward distance which will have been travelled after the next step, and compares this time with the preset maximum rest time or pause.

Rapid conversion of the machine to different transverse bar spacings, and special corrections of the transporting step length can be carried out in a simple manner and from case to case by programming the computer appropriately. Also it is possible to arrange a compromise between small cumulative errors of the transporting steps on one hand, and a higher production rate on the other hand.

The invention also includes apparatus for carrying out the method, the apparatus comprising an element arranged to engage a transverse rod of the grid at a starting position, moving means for moving the element forward through a number of steps at a first mean speed, and backwards at a mean speed greater than the first mean speed, a computer for calculating whether or not the time required for the return of the element to its starting position from the position which it would occupy after the next step is greater than a preset maximum rest time between steps, and, if it is, causing the moving means to return the element to its starting position before the next step forward.

Hydraulic motors with servo control systems can be used to ensure a travelling path length with high accuracy without use of any mechanical stops and these path lengths can be rapidly changed by the dimensions of the required transverse rod spacing by a computer controlled motor and special corrections of these travelling paths can be carried out, for example corrections depending on the temperature of the longitudinal rods. The proposed significant increase of the velocity of return movement of the transport elements, in comparison with the transporting movements themselves, is readily achieved with regard to the fact that the return movement takes place without a load; the transporting movements, however, are carried out under full loading by the reinforcement grid; this is possible because in the case of a relatively short maximum rest time, in which case the production rate of the machine is only slighly reduced, it is possible to use a large number of directly succeeding transporting steps and hence the total error can be largely reduced. In the preferred embodiment form of the invention the maximum standstill time of the reinforcement grid is selected to be equal to that rest time which is required anyway for welding of a transverse rod and which consists of the squeeze time, weld time and forging time so that the multiple spot welding machine works with its normal cycle.

One arrangement designed according to the invention for the carrying out of the above described process with a multiple spot welding machine suitable for reinforcement grid production has a slide or carriage travelling on rails at the delivery side of the grid welding machine. This slide or carriage has transporting elements engaging with one transverse rod of the reinforcement grid and these elements are used for step by step transport of the reinforcement grid according to the required transverse rod spacing, this arrangement being basically characterised by the fact that on the slide or on the carriage is arranged a reversible hydraulic motor for ensuring movements, preferably by means of a toothed pinion and a toothed rack, of the carriage along the rails. This driving motor can be connected by means of a pulse generator which signals the position changes of the carriage and which pulse generator is connected with a path length measuring system in the computer which controls an electrohydraulic changeover valve in the feed circuit of the carriage drive motor.

One example of a method and apparatus according to the invention will now be described with reference to the accompanying drawings in which.

Figure 1:
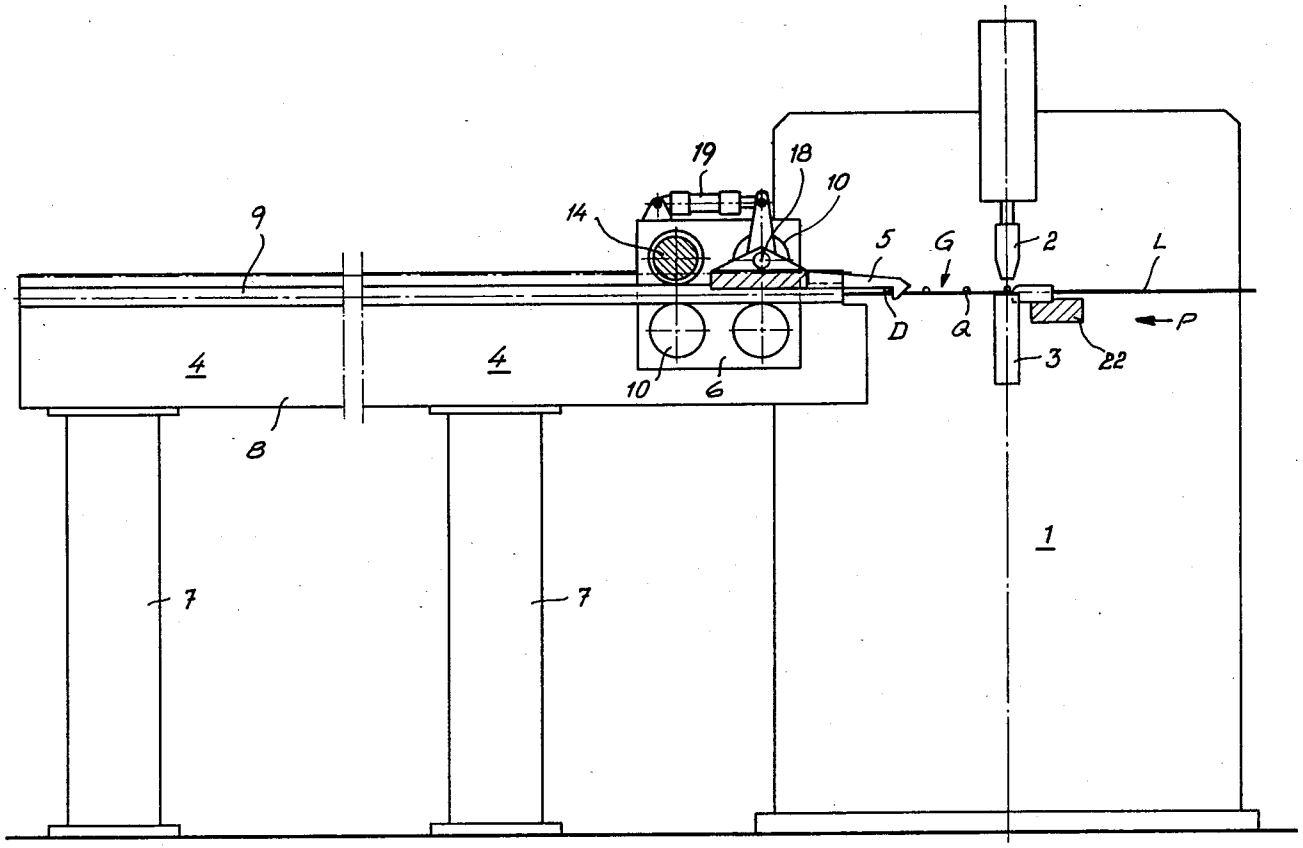
FIG. 1 shows the apparatus in side view and partly in section.
Figure 2:
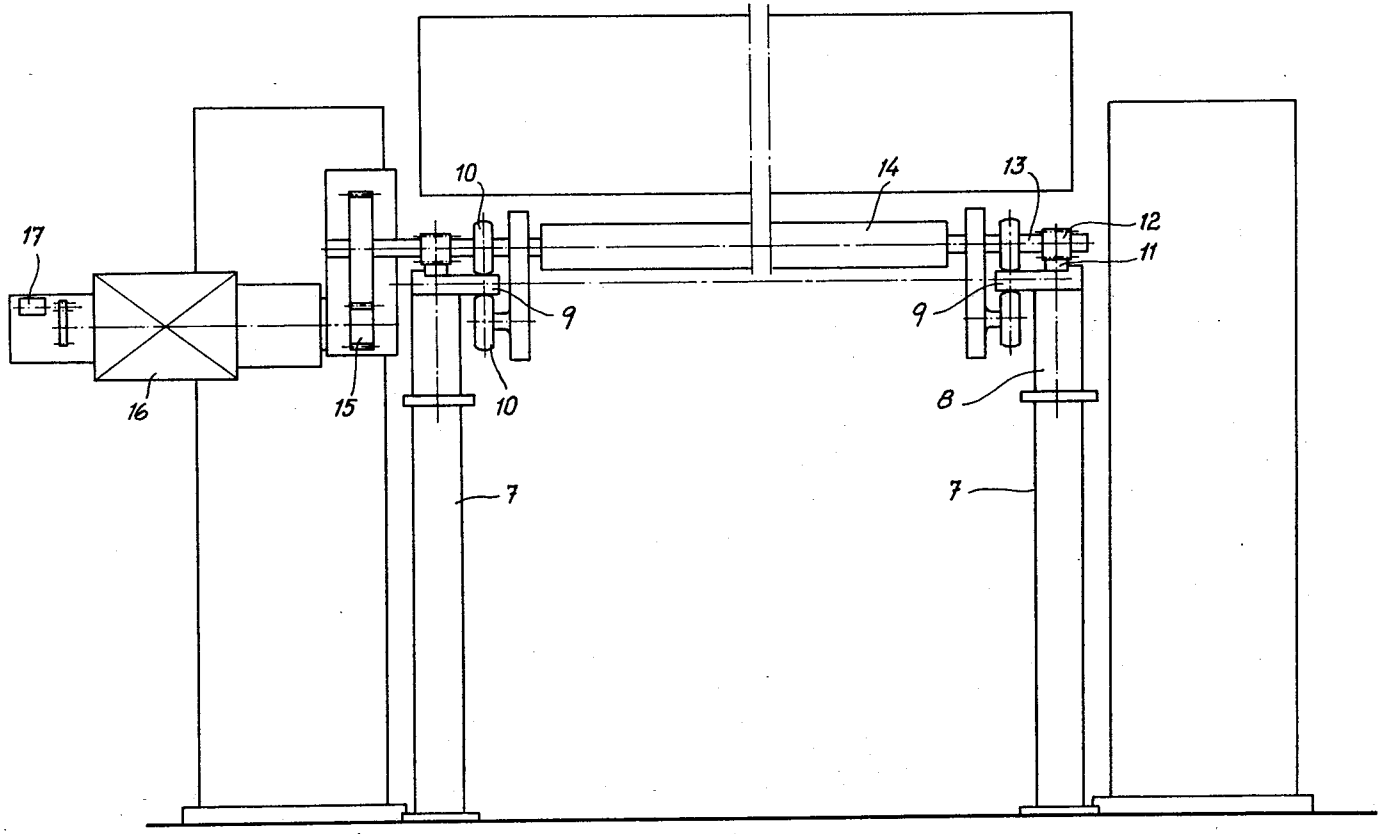
FIG. 2 shows the apparatus from the reinforcement grid running-out end.
Figures 3, 4A, 4B:
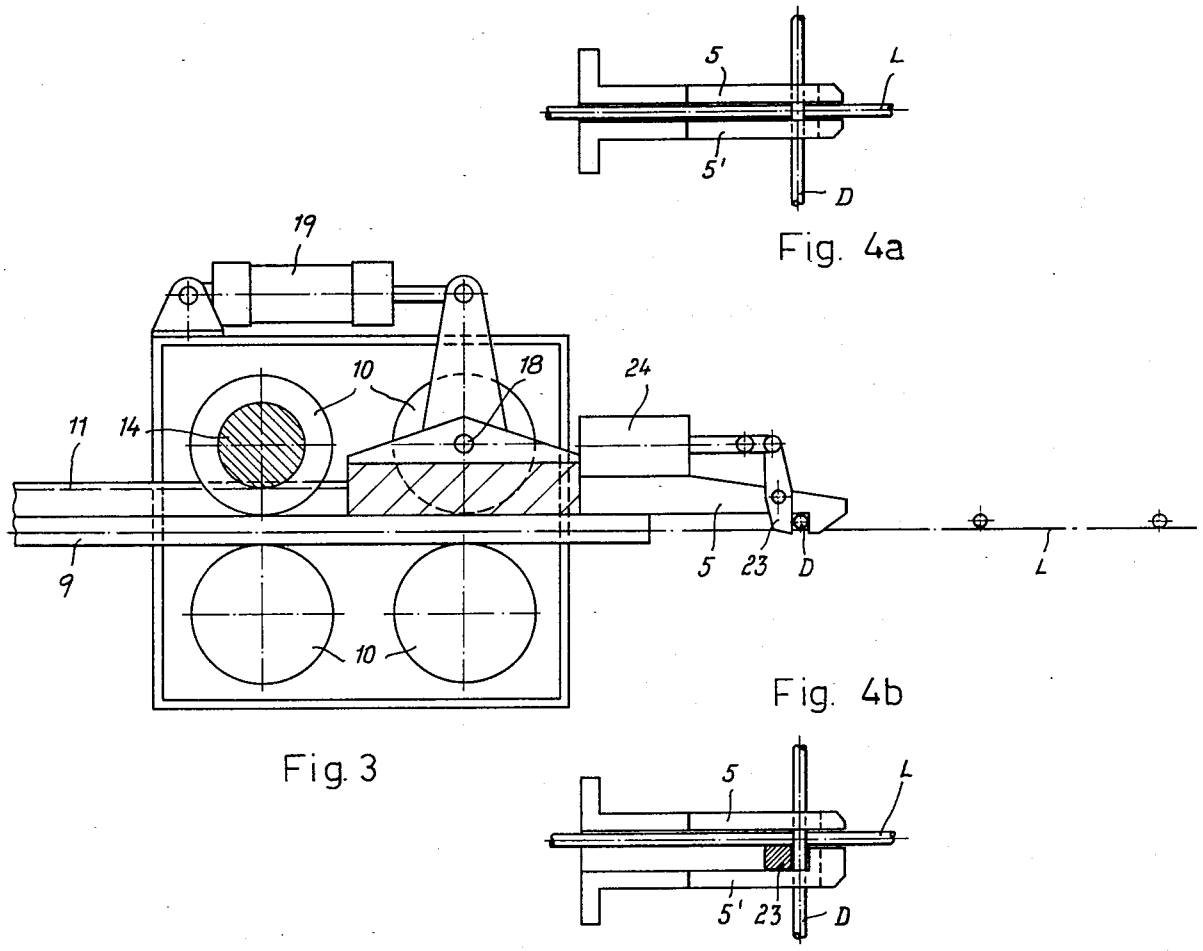
FIG. 3 shows the transporting carriage of the apparatus of FIG. 1 partly in section.
Figure 5:
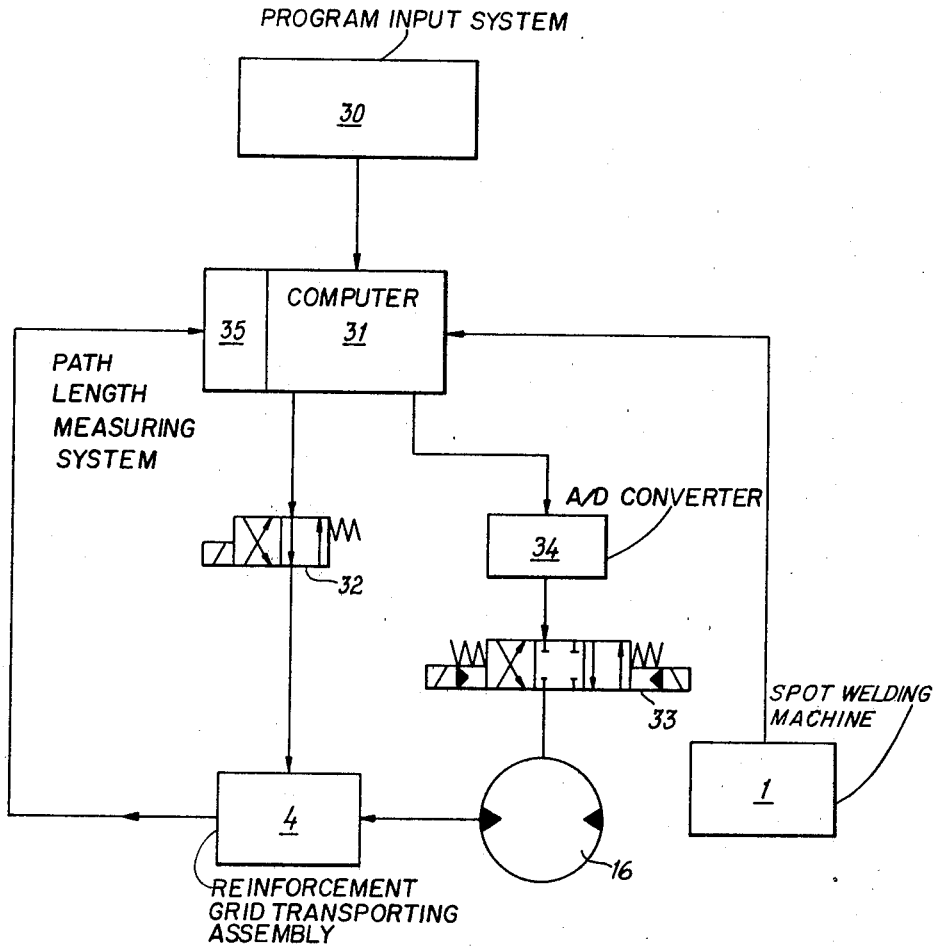
Figure 6:
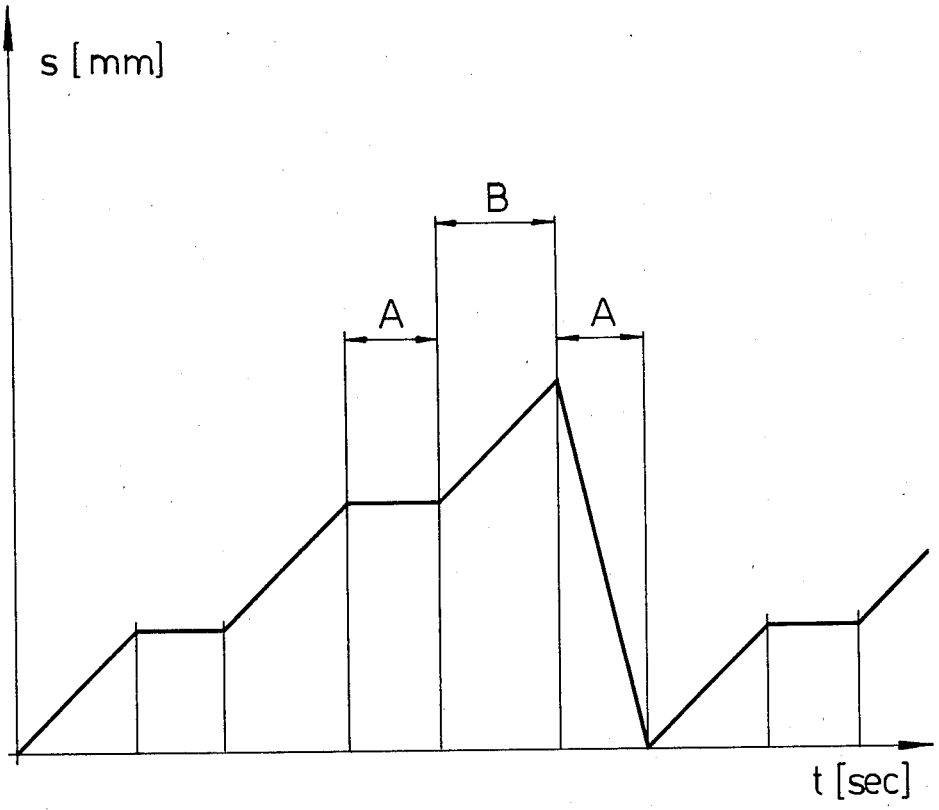

FIGS. 4*a* and 4*b* show plan views of preferred embodiment forms of transporting elements;

FIG. 5 is a diagram of the control circuit of the apparatus; and,

FIG. 6 is a time-displacement diagram of the preferred path covered by the transporting carriage.

The apparatus is adapted to cooperate with a multiple spot welding machine 1, operating on the electrical resistance principle and to which are supplied longitudinal rods L for the reinforcement grid in the direction of arrow P and transverse rods Q for example in a direction at right angles to the plane of the grid. The rods L and Q pass between welding electrode rows 2 and 3 (indicated only diagrammatically,) and are welded together thereby. A computer 31 (see FIG. 5) controls, step-by-step, transportation of the reinforcement grid transporting assembly 4, whose individual steps can be adjusted according to the transverse rod spacing required. The rest times or pauses between the individual transporting steps are also adjustable, according to the rod material used and the squeeze, weld and forging times, which are dependent on the diameter of the rod, by means of the computer 31. A number of hooks 5 are mounted on a carriage 6 of the transporting assembly 4 and engage an already welded transverse rod D of the reinforcement grid G which is in the production process, in order to move the reinforcement grid forward by the required transverse rod spacing after each welding operation.

A track for the carriage 6 is supported by side columns 7, which are bridged by longitudinal beams 8, to which are attached inwardly projecting running rails 9. As seen in the drawing, each of the running rails 9 is gripped between two upper and two lower wheels 10 of the carriage 6.

On each of the two running rails 9 is fixedly arranged a toothed rack 11 which engages with a correspondingly toothed pinion 12. The toothed pinions 12 are connected to a shaft 13 for rotation therewith, the middle part 14 of the shaft being reinforced in order to eliminate, as far as possible, any torsional twisting of the shaft 13. The shaft 13 is driven via a gear drive 15 by a hydraulic motor 16 which is mounted on a stand and is movable with the carriage. The motor 16 is connected to a pulse generator 17, which for each movement of the motor and for each of the displacements of the reinforcement grid G caused by this movement generates a pulse, due to which the given position of the hook 5 or of the reinforcement grid G held by such a hook is accurately fixed in relation to a specified reference position.

The transporting carriage 6 has a box-shaped housing, on which are held, (see FIG. 3) the hooks 5 which are able to pivot within predetermined limits about an axis 18. Each transporting hook 5 is pivoted by a connected hydraulic cylinder 19 which makes it possible to bring the hook into engagement with an already welded transverse rod D. Each hook 5 can be supplemented by a swivelling clamping lever 23, which is actuated by a further hydraulic cylinder 24, to form a gripper. This design ensures that the reinforcement grid G, which is transported rapidly from one step to another, cannot move further than required under the effect of inertial forces, which would otherwise be especially possible when the reinforcement grids are made from thick rods.

Especially in the case of reinforcement grids made from thin rods it is recommended, as shown in FIG. 4*a*, to arrange the hooks 5, 5' in pairs on both sides of the longitudinal rods L and directly adjacent to these rods, in order to prevent any bending of the transverse rods D during transport of the grids. FIGS. 4*b* shows, in diagrammatic form, a similarly designed double hook 5, 5', which acts as a gripper in conjunction with a clamping lever 23 (shown in section) such as shown in FIG. 3.

It is an advantage to provide a non-return blocking mechanism 22 at the welding station, the blocking mechanism having stops for the welded transverse rod Q. On welding machines in which the reinforcement grid longitudinal rods L are drawn from storage spools, the reinforcement grid can be prevented from being retracted, during the time when the hook 5 is not in engagement with a transverse bar D, due to elastic forces, in the direction of the storage spools. Hence, the non-return blocking devices 22 and the hooks 5 or grippers 5, 23 can be used to bring the reinforcement grid into a completely specified, established position and held there firmly.

The length of the individual transporting steps is inputted (see FIG. 5) into a program input system 30. A computer 31 evaluates from this the input values for the required, successive positions by which the transporting carriage 6 must be moved so that individual transverse rods can be welded at the required spacings onto the reinforcement grid longitudinal rods.

In the computer 31 the required transporting steps can be changed by specified factors in a proportional manner, in order to be able to compensate for unavoidable thermal expansion of the longitudinal rods on welding.

Additionally it is possible to input to the computer 31 also the allowable maximum rest times or pauses of the reinforcement grid. The longer these are selected, the smaller becomes the cumulative error, but of course the more the production rate will fall. The selection of the maximum rest time depends therefore on whether any special accuracy in the forming of the reinforcement grid is required, or if greater value is placed on a high production rate. In a limiting case the time which is necessary for a welding operation and which consists of the squeeze time, actual weld time and the time for subsequent forging can be used as the maximum rest time. In addition the required speeds for the step-by-step transporting of the reinforcement grid and for the return movement of the transport carriage 6 are stored in the computer.

The computer 31 controls, on the one hand, by means of an electrohydraulic spool 32, the movements of the transporter hook 5, so that this hook 5 will grip at a specified point of time a certain specified transverse rod or will release it, and on the other hand, controls the hydraulic motor 16 of the transporting assembly 4 by means of an electrohydraulic valve 33 to which there is connected upstream thereof a digital-analogue converter 34. The valve 33 is designed so that it controls the pressurised fluid supplied to the motor 16 in proportion to the voltage applied to the converter 34 by the computer 31. A path length measuring system 35, measures the accurate position of the carriage 6, during each movement along the running rails 9 by totalling the pulses emitted by the pulse generator 17 and by multiplying the number of pulses with the given distance covered between two pulses. The value determined in this manner is also fed into the computer as a signal from the welding machine 1, as soon as the reinforcement grid is released by the electrodes and is ready for transporting onwards.

The transport of the reinforcement grid is carried out in such a manner that the hooks 5 will grip a transverse bar D and hold it firmly during a number of transporting steps. The computer 31 evaluates continuously, from the specified speed of the return movement of the carriage 6 as well as from distance already covered plus the distance of travel yet to be covered on the next transporting step, the time which would be necessary to return the carriage 6 to its starting position after completion of the next transporting step. If this time is smaller than the programmed maximum rest time of the reinforcement grid (which is preferably equal to the rest time necessary for a welding operation) then the next transporting step is carried out as previously with the hooks 5 remaining engaged with the same transverse bar D. If the computation, however, indicates that the time necessary for the return movement of the carriage 6 after the next transporting step is greater than the specified maximum rest time of the reinforcement grid, then the hooks 5 are released from the reinforcement grid G and the carriage 6 is guided back, so that the hooks 5 can engage another transverse bar which is closer to the welding line.

Owing to the width of the electrodes it is not possible to carry out gripping of the reinforcement grid within the electrode range, i.e. on the welding line. For this reason the computer evaluates preferentially the position of a transverse rod which is already welded onto the longitudinal rods and situated away from the welding line and brings the carriage 6 only back so far that the hooks 5 are able to grab the selected transverse rod.

FIG. 6 shows the time-displacement diagram of the transporting carriage 6 by assuming that the return time of the carriage 6 is equal to the rest time A required for a welding operation. The time required for the execution of a transporting step is designated as B. It can be seen that in the example shown the carriage returns after three transporting steps to its initial position.

We claim:

1. In a method of moving a grid forward longitudinally in stepwise fashion, with a pause between each step, through a multi-spot welding machine, said grid comprising a plurality of longitudinal rods and a plurality of transverse rods welded thereto in said welding machine, at selected spacings, said machine including an element adapted to engage one of said transverse rods at a starting position, to move thereafter said grid in a forward direction through a number of steps and pauses at a first mean speed, to be disengaged subsequently from said trasnverse rod, and following the disengagement from said transverse rod to return to said starting position in an opposite direction at a second mean speed higher than said first mean speed, each step in the forward direction including a movement at a forward speed, followed by a pause having a duration up to a maximum duration the improvement comprising the steps of establishing a time interval required for said element to return to said starting position at a second mean speed after having advanced an additional forward step beyond said number of steps, and having rested during said maximum pause duration, comparing said time interval with the time required for said element to return to said starting position at said second mean speed following the disengagement from said transverse rod, and returning said element to said starting position if said time interval is determined to be greater than said maximum pause duration.

2. A method according to claim 1, wherein said preset maximum pulse duration is set substantially equal to the time required for welding of a transverse rod to said longitudinal rods in said welding machine.

3. Apparatus adapted for moving a grid forward longitudinally in stepwise fashion, with a pause between each step, through a multi-spot welding machine, said grid comprising a plurality of longitudinal rods and a plurality of transverse rods welded thereto in said welding machine, at selected spacings, said apparatus comprising an element adapted to engage one of said transverse rods at a starting position, to move said grid thereafter in a forward direction through a number of steps and pauses at a first mean speed, to be disengaged subsequently from said transverse rod, and following the disengagement from said transverse rod, to return to said starting position at a second mean speed higher than said first mean speed, each step in the forward direction including a movement at a forward speed, followed by a pause having a duration up to a maximum duration, determining means for establishing a time interval required for said element to return to said starting position at said second mean speed after having advanced an additional forward step beyond said number of steps, and having rested during said maximum pause duration, comparing means for comparing said time interval with the time required for said element to return to said starting position at said second mean speed following the disengagement from said transverse rod, and returning means for returning said element to said starting position if said time interval is determined to be greater than said maximum pause duration.

4. Apparatus according to claim 3, wherein said means for establishing said time interval and said comparing means include a computer, and said returning means include a reversible hydraulic motor connected to said element, said computer controlling said motor so as to return said element to said starting position if said time interval is determined to be greater than said maximum pause duration.

5. Apparatus according to claim 4, including a pair of rails and a carriage mounted on said rails, said element being mounted on said carriage, and said motor driving said carriage.

6. Apparatus according to claim 5, including a toothed rack mounted on each of said rails; and a pair of toothed pinions mounted on said carriage in engagement with said racks, said hydraulic motor driving said pinions.

7. Apparatus according to claim 3, including a path-length measuring unit in said computer; and a pulse generator for signalling position changes of said element to said measuring unit.

8. Apparatus according to claim 4, including an electrohydraulic valve for changing the direction of flow of fluid to said motor, said computer controlling operation of said valve.

9. Apparatus according to claim 3, wherein said element comprises a hook.

10. Apparatus accordin to claim 9, further comprising a lever adapted to cooperate with said hook to form a clamp adapted to engage one of said transverse rods.

11. Apparatus according to claim 9 or claim 10, further including hydraulic means for pivoting said hook for engagement or disengagement with said one of said transverse rods; and a hydraulic spool valve operating said hydraulic means, said computer controlling operation of said spool valve.

12. Apparatus according to claim 4, wherein said computer includes means for storing the values of the required spacing between said transverse rods, said values being adapted to be modified by a common factor within said computer.

13. Apparatus according to claim 3, further including said multi-spot welding machine, said machine including storage coils for said longitudinal rods and a non-return blocking device engaging one of said transverse rods to prevent recoil of said longitudinal rods onto said coils.

* * * * *